US008037906B1

(12) United States Patent
Grillo

(10) Patent No.: US 8,037,906 B1
(45) Date of Patent: Oct. 18, 2011

(54) FILLING STATION FOR WATER-BASED TOYS

(76) Inventor: Edward J. Grillo, Saint Peters, MO (US)

( * ) Notice: Subject to any disclaimer, the term of this patent is extended or adjusted under 35 U.S.C. 154(b) by 631 days.

(21) Appl. No.: 12/231,821

(22) Filed: Sep. 5, 2008

(51) Int. Cl.
*B65B 1/04* (2006.01)

(52) U.S. Cl. ..... 141/10; 273/349; 141/114; 472/128

(58) Field of Classification Search ..... 141/10, 141/114, 234–237, 247, 313, 317, 386; 273/349, 273/398–402; 472/128
See application file for complete search history.

(56) References Cited

U.S. PATENT DOCUMENTS

| | | | | |
|---|---|---|---|---|
| 1,916,988 | A | 7/1933 | Pieschke | |
| 3,537,430 | A | 11/1970 | Peppler | |
| 4,753,196 | A | 6/1988 | Lack et al. | |
| 5,146,873 | A | 9/1992 | Gray | |
| 5,154,138 | A | 10/1992 | Siddiqui et al. | |
| 5,282,440 | A | 2/1994 | Hostetler | |
| D348,546 | S | 7/1994 | Johnson | |
| 5,480,336 | A * | 1/1996 | Blanchard | 446/89 |
| 5,482,292 | A * | 1/1996 | Stone | 273/384 |
| 5,649,867 | A * | 7/1997 | Briggs | 472/128 |
| 5,779,240 | A * | 7/1998 | Santella | 273/349 |
| 5,803,328 | A * | 9/1998 | Nakahara | 224/420 |
| 5,820,472 | A * | 10/1998 | Briggs | 472/128 |
| 5,857,429 | A | 1/1999 | Hostetler | |
| 6,050,872 | A | 4/2000 | Cahill et al. | |
| 6,318,290 | B1 | 11/2001 | Fisher | |
| 6,591,782 | B1 | 7/2003 | Googe, Jr. et al. | |
| 6,745,414 | B2 * | 6/2004 | Zhou | 4/599 |
| 6,782,844 | B2 | 8/2004 | Winney | |

* cited by examiner

*Primary Examiner* — Dinh Nguyen
*Assistant Examiner* — Jennifer Gordon
(74) *Attorney, Agent, or Firm* — Montgomery Patent & Design; Robert C. Montgomery; Joseph T. Yoksich

(57) ABSTRACT

An apparatus designed to fill multiple water balloons and other water-based toys at the same time is herein disclosed. The apparatus takes the form of a large stand approximately thirty-four (34) inches high and twenty-four (24) inches wide made using polyvinylchloride (PVC) piping and fittings. The apparatus is supported across the bottom using two (2) "T"-shaped legs, also made of PVC pipe. A water connection to a standard garden hose is provided on one (1) leg near the bottom. Four (4) angled valves are provided across a top portion, such that up to four (4) users can use the apparatus simultaneously to refill water-based toys such as squirt guns or water balloons. When finished at each station, each user can easily turn off an individual valve, thus avoiding the wasting of water.

16 Claims, 2 Drawing Sheets

FILLING STATION FOR WATER-BASED TOYS

RELATED APPLICATIONS

The present invention was first described in a notarized Official Record of Invention on Jun. 5, 2007, that is on file at the offices of Montgomery Patent and Design, LLC, the entire disclosures of which are incorporated herein by reference.

FIELD OF THE INVENTION

The present invention relates generally to an apparatus designed to fill multiple water balloons and other water-based toys at the same time and, more particularly, to said apparatus comprising polyvinylchloride (PVC) piping and fittings, a water connection to a standard garden hose, and four (4) angled valves, such that up to four (4) users can use the apparatus simultaneously to refill water-based toys such as squirt guns or water balloons.

BACKGROUND OF THE INVENTION

Just about all of us have fond memories of summertime when we were children. Playing with or in water is usually part of this fun, whether in a pool or running through a sprinkler. Using a squirt gun or playing with water balloons may be part of this fun as well. Typically, when filling such a toy, a water spigot or garden hose is used. While such a water source does the job, it does present several disadvantages. First, only one child can use the water source at a time. This obviously presents a problem when a large number of kids are present and definitely cuts into the "fun" time. Secondly, in the case of a hose, it is usually left on between fills, thus wasting water. Finally, the large opening of the spigot or hose make it difficult to attach the small opening of a water balloon or the fill opening of a squirt gun. Accordingly, there exists a need for a means by which water-based toys can be easily filled without the disadvantages as described above. The development of the invention herein fulfills this need.

The present invention is an apparatus designed to fill multiple water balloons and/or squirt guns at the same time from a garden hose. The apparatus takes the form of a large square stand approximately thirty-four (34) inches high and twenty-four (24) inches wide, made of one-half (½) inch, three-fourths (¾) inch and one (1) inch PVC pipe. The apparatus is supported across the bottom using two (2) "T"-shaped legs, also made of PVC pipe. A water connection to a standard garden hose is provided on one (1) leg near the bottom. A set of four (4) small water flow valves are provided across the top portion with two (2) angled out to each side. In such a manner four (4) users can use the apparatus simultaneously to refill water based toys such as squirt guns or fill water balloons. When finished at each station, the user can easily turn off the water supply to each individual valve, thus avoiding the wasting of water. The use of the present apparatus provides a means for filling almost any type of water based toy in a manner which is not only quick, easy and effective, but allows for multiple fillings at the same time while reducing water waste.

Several attempts have been made in the past to provide watering systems. U.S. Pat. No. 6,050,872, issued in the name of Cahill et al., discloses a toy carwash unit comprised of a free-standing frame, a water-carrying conduit supported by the frame, and a spray head. However, the Cahill et al. device is designed to allow passage of a vehicle to a washing location within the frame. Furthermore, the Cahill et al. device does not have four (4) water valves being angled outwardly to allow multiple users to simultaneously fill or refill water-based toys. Also, the Cahill et al. device does not have a "T"-shaped leg structure, a panel, a border, and a pair of pockets for holding water-based toys among other differences.

U.S. Pat. No. 4,753,196, issued in the name of Lack et al., discloses a water line suspended from drop cables for carrying water or other fluids for poultry or other animals. Furthermore, U.S. Pat. No. 3,537,430, issued in the name of Peppler, U.S. Pat. Nos. 5,282,440 and 5,857,429, issued in the name of Hostetler, also disclose poultry watering systems. However, unlike the present invention, all of these poultry watering systems are not capable of standing upright on the ground and do not allow multiple users to simultaneously fill or refill water-based toys.

U.S. Pat. No. 6,591,782, issued in the name of Googe, Jr. et al., discloses a field watering device for game birds that comprises a body for holding water, a ground anchor portion for securely fixing the body into the ground, and at least one (1) water dispensing nipple for dispensing water from the body to the game birds. However, the Googe, Jr. device does not have a horizontal manifold, a first upright, a second upright, a pair of free, and a pair of pockets among other differences. Furthermore, the Googe, Jr. et al. device does not allow multiple users to simultaneously fill or refill water-based toys.

Additionally, various ornamental designs for watering systems have been provided, particularly, U.S. Pat. Number D 348,546. However, none of these designs are similar to the present invention.

None of the prior art particularly describes an apparatus designed to fill multiple water balloons and other water-based toys comprising PVC piping and fittings, a water connection to a standard garden hose, and four (4) angled valves, such that up to four (4) users can use the apparatus simultaneously to refill water-based toys such as squirt guns or water balloons that the instant invention possesses. Accordingly, there exists a need for a means by which water based toys can be easily filled simultaneously without the disadvantages as described above.

SUMMARY OF THE INVENTION

In view of the foregoing disadvantages inherent in the prior art, it has been observed that there is need for a means by which water based toys can be easily filled simultaneously comprising PVC piping and fittings, a water connection to a standard garden hose, and four (4) angled valves, such that up to four (4) users can use the apparatus simultaneously to refill water-based toys such as squirt guns or water balloons.

To achieve the above objectives, it is an object of the present invention to provide a water-based toy refilling apparatus comprising a horizontal manifold comprising a first end connected to a first top end of a first upright by a first elbow fitting and having a second end connected to a second top end of a second upright by a second elbow fitting at an opposite end.

A further object of the present invention is having the apparatus comprise the first upright having a first bottom end connected to a first foot portion by a first tee fitting and the second upright having a second bottom end connected to a second foot portion by a second tee fitting.

Another object of the present invention is having the apparatus comprise at least one (1) water flow valve mounted thereto the horizontal manifold by at least one (1) water flow valve tee fitting and a garden hose adapter affixed thereto a lower portion of the first upright or the second upright by a third tee fitting providing a fluid connection means thereto a standard garden hose, thereby providing a water flow to the apparatus.

Another object of the present invention is having the refilling apparatus enable a plurality of users to simultaneously fill a plurality of water-based toys.

A further object of the present invention is having the apparatus further comprise a panel having a front surface and a rear surface connected to the first upright and the second upright by at least one (1) panel clamp and at least one (1) pocket attached to the front surface and the rear surface of the panel by a border portion, wherein the at least one (1) panel clamp wraps around the first upright and the second upright and is affixed thereto the front surface and the rear surface of the panel.

Another object of the present invention is having the panel comprise a sturdy vertical flat surface made using plastics or metal materials being approximately twelve (12) inches tall and one-eight (⅛) to one-quarter (¼) inch thick.

Yet another object of the present invention is the at least one (1) panel clamp is an open-ended clip which provide a clamping friction-fit thereto the first upright and said second upright and affix to said front surface and said rear surface of said panel by a first plurality of fasteners, the pockets comprise three (3) sided open-top enclosures made using open nylon or polypropylene mesh webbing with an elastic upper edging affixed using adhesives, sewing techniques, or similar means and, the border comprises a flat plastic or metal plate approximately one (1) inch wide covering a side edge and a lower edge of the pocket, thereby clamping the pocket securely thereagainst the panel by a second plurality of fasteners.

Yet another object of the present invention is having the water flow valves each comprise an "L"-shaped handle or a "T"-shaped handle and an outlet port which provides an attachment means thereto a nozzle, thereby providing a gripping and a holding means thereto one of said plurality of water-based toys.

Still yet another object of the present invention is the at least (1) water flow valve is angularly mounted thereto the horizontal manifold by at least (1) water flow valve tee fitting.

Still yet another object of the present invention is having the apparatus comprise four (4) panel clamps and two (2) pockets.

Yet still another object of the present invention is having the apparatus comprise four (4) water flow valves and four (4) water flow valve tee fittings.

Still another object of the present invention is having the four (4) water flow valves each angularly mounted downwardly from a horizontal plane at an approximately forty-five degree (45°) angle therefrom the horizontal manifold by the four (4) water flow valve tee fittings, wherein the water flow valve tee fittings are arranged such that two (2) water flow valve tee fittings face in a forward direction and two (2) water flow valve tee fittings face in a rearward direction in a staggered or alternating pattern.

Still yet another object of the present invention is having the first foot portion and the second foot portion form two (2) parallel stabilizing members being approximately thirty (30) inches in length and arranged approximately thirty-four (34) inches therebetween providing a stable foundation thereby preventing sliding or tipping of said apparatus during use.

Yet another object of the present invention is having the horizontal manifold, the first upright, and the second upright form an inverted "U"-shaped structure approximately twenty-four (24) inches wide and approximately thirty-four (34) inches high.

Still yet another object of the present invention is having the first upright and the first foot portion form a "T"-shaped leg structure.

Yet still another object of the present invention is having the second upright and the second foot portion form a "T"-shaped leg structure.

Still another object of the present invention is having the garden hose adapter comprise a standard plumbing fitting being fastened thereto the third tee fitting.

Still yet another object of the present invention is having the garden hose adapter made using PVC, brass, copper, or a combination thereof.

Yet another object of the present invention is having the horizontal manifold, the first upright, the second upright, the first foot portion, and the second foot portion each made of common PVC piping.

Still another object of the present invention is having the horizontal manifold, the first upright, the second upright, the first foot portion, and the second foot portion each made of brass, copper, or similar materials.

Yet another object of the present invention is providing a method for using a water-based toy refilling apparatus that allows a plurality of water-based toys to be easily filled simultaneously by a plurality of users.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

| | |
|---|---|
| 10 | filling station for water-based toys |
| 20 | piping |
| 21 | tee fitting |
| 22 | elbow fitting |
| 24 | garden hose adapter |
| 25 | cap fitting |
| 26 | water flow valve |
| 27 | handle |
| 28 | nozzle |
| 29 | water flow valve tee fitting |
| 40 | panel |
| 41 | clamp |
| 42 | first set of fasteners |
| 43 | pocket |
| 44 | elastic |
| 45 | border |
| 46 | second set of fasteners |
| 50 | horizontal manifold |
| 51 | first upright |
| 52 | second upright |
| 53 | foot |
| 60 | balloon |
| 70 | ground surface |
| 80 | garden hose |

DETAILED DESCRIPTION OF THE PREFERRED EMBODIMENT

Figure 1:
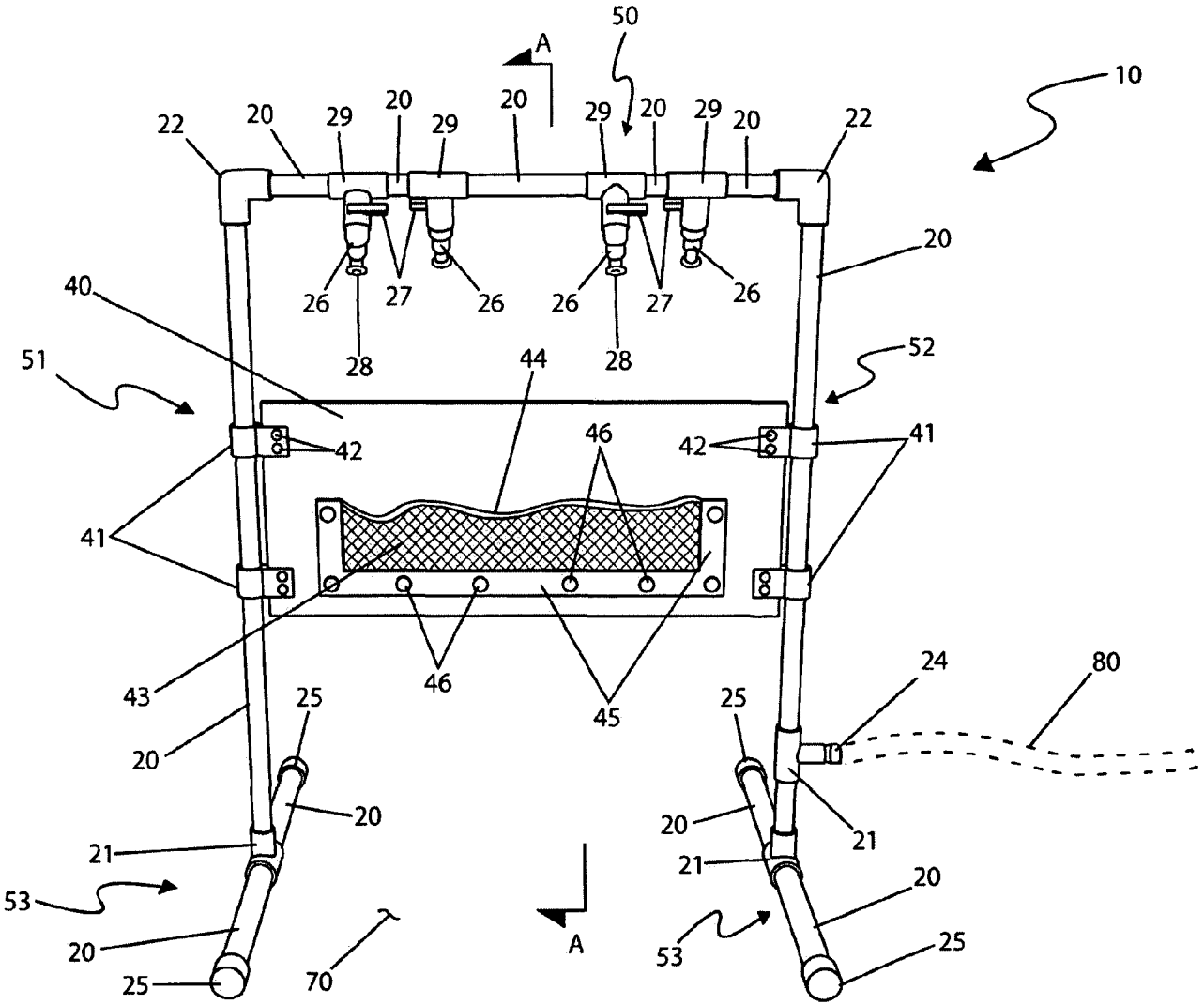
FIG. 1 is a front perspective view of a filling station for water-based toys 10, according to a preferred embodiment of the present invention; and, FIG. 2 is a side section view of a filling station for water-based toys 10 taken along section A-A, according to a preferred embodiment of the present invention.
Figure 2:
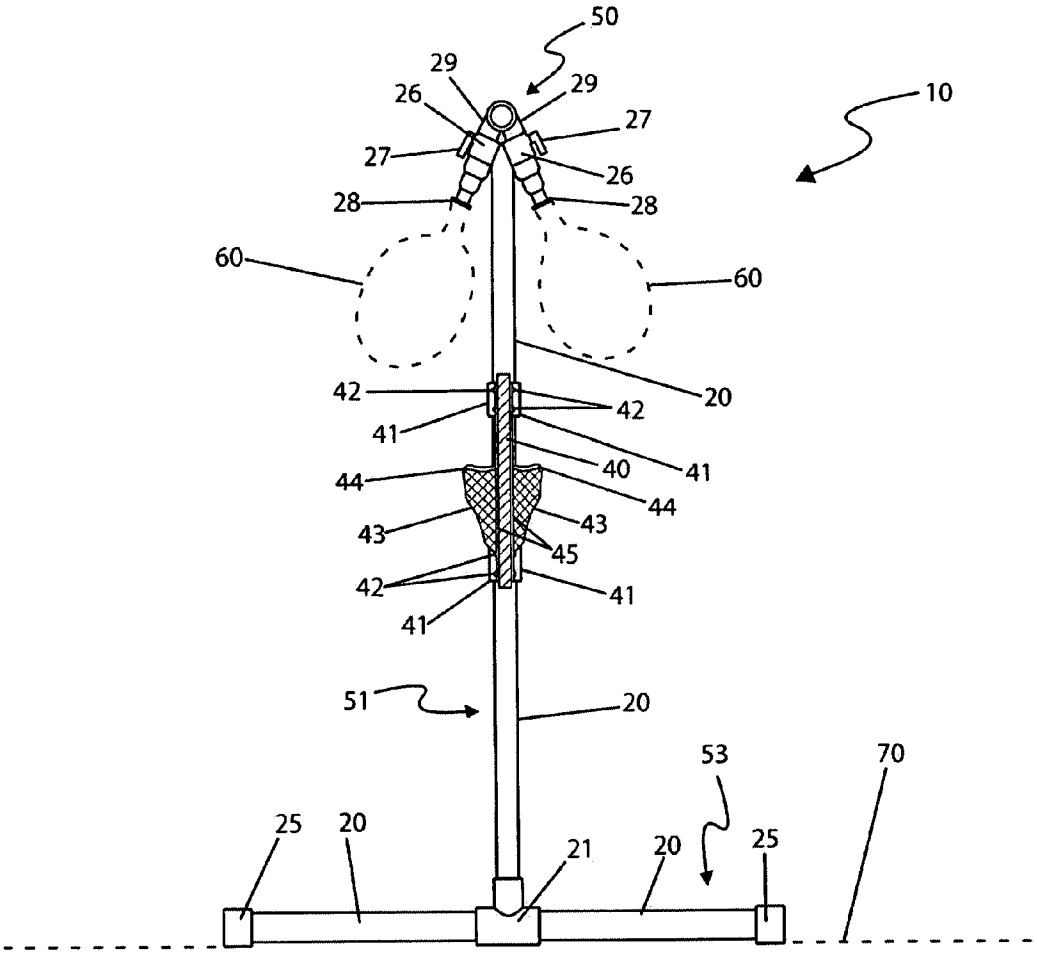

The best mode for carrying out the invention is presented in terms of its preferred embodiment, herein depicted within FIGS. 1 and 2. However, the invention is not limited to the described embodiment and a person skilled in the art will appreciate that many other embodiments of the invention are possible without deviating from the basic concept of the invention, and that any such work around will also fall under scope of this invention. It is envisioned that other styles and configurations of the present invention can be easily incorporated into the teachings of the present invention, and only one particular configuration shall be shown and described for purposes of clarity and disclosure and not by way of limitation of scope.

The terms "a" and "an" herein do not denote a limitation of quantity, but rather denote the presence of at least one of the referenced items.

The present invention describes an apparatus and method for a filling station for water-based toys (herein described as the "apparatus") 10, comprising a large stand made using polyvinylchloride (PVC) plumbing elements which provides a filling means for a plurality of water balloons 60 or other water-based toys. The apparatus 10 provides a connection thereto a common garden hose 80 which supplies a water flow thereto four (4) small water flow valves 26 being angled outwardly toward either side of the apparatus 10. In such a manner, up to four (4) users such as children can use the apparatus 10 simultaneously to fill or refill water-based toys such as balloons 60, squirt guns, or the like. When finished at each station, a user may easily turn off said water supply, thus conserving water usage.

Referring now to FIG. 1, a front perspective view of the apparatus 10, according to the preferred embodiment of the present invention, is disclosed. The apparatus 10 comprises a horizontal manifold 50, a first upright 51, a second upright 52, a pair of feet 53, a garden hose adapter 24, four (4) water flow valves 26, a panel 40, four (4) panel clamps 41, a first set of fasteners 42, a second set of fasteners 46, and a pair of pockets 43. The horizontal manifold 50, a first upright 51, a second upright 52 comprise a one-piece assembly of common PVC piping 20 and fittings forming an inverted "U"-shaped structure approximately twenty-four (24) inches wide and approximately thirty-four (34) inches high. The horizontal manifold 50, first upright 51, and second upright 52 also provide a conduit means thereto a flow of water therethrough to four (4) valves 26 being angularly mounted thereto the horizontal manifold 50. The horizontal manifold 50 further comprises a linear assembly of four (4) water flow valve tee fittings 29 being interconnected by lengths of piping 20 envisioned to be one-half (½) or three-quarter (¾) inch plumbing. The water flow valve tee fittings 29 are arranged such that two (2) water flow valve tee fittings 29 face in a forward direction and two (2) water flow valve tee fittings 29 face in a rearward direction in a staggered or alternating pattern. Furthermore, said water flow valve tee fittings 29 are angled downwardly therefrom a horizontal plane at approximately a forty-five degree (45°) angle. Each water flow valve tee fitting 29 provides an attachment means thereto a water flow valve 26 providing a filling means thereto a toy or balloon (see FIG. 2). The horizontal manifold 50 further provides an attachment means thereto a first upright 51 and a second upright 52 via joining elbow fittings 22 located at opposite end portions. The first 51 and second 52 uprights each form a "T"-shaped leg structure comprising a vertical length of PVC piping 20 extending downwardly therefrom said elbow fitting 22 thereto a tee fitting 21 located adjacent thereto a ground surface 70. Each tee fitting 21 in turn provides an attachment means thereto a pair of PCV piping elements 20 which extend perpendicularly therefrom in opposing directions forming a horizontal foot 53. The foot portions 53 of the first 51 and second 52 uprights form two (2) parallel stabilizing members being approximately thirty (30) inches in length and arranged approximately thirty-four (34) inches therebetween providing a stable foundation, thereby preventing sliding or tipping of the apparatus 10 during use.

The piping 20 and fittings 21, 22, 25, 29 described herein are envisioned to be common one-half (½) or three-quarter (¾) inch commercially available plumbing fittings; however, it is understood that custom molded fittings combining functions of two (2) or more included fittings may be provided to improve manufacturability or economics and as such should not be interpreted as a limiting factor of the invention 10. Furthermore, the piping 20 and fittings 21, 22, 25, 29 are envisioned being preferably made using a PVC material; however, the use of other pressure-bearing materials may provide equal benefit such as brass, copper, or the like, without deviating from the concept and as such should not be interpreted as a limiting factor of the invention 10.

Said vertical piping portions 20 of the first 51 and second 52 uprights provide an attachment means thereto a panel 40 which spans therebetween said vertical piping portions 20 being connected thereto via four (4) clamps 41. The panel 40 comprises a sturdy vertical flat surface made using plastic or metal materials being approximately twelve (12) inches tall and one-eighth (⅛) to one-quarter (¼) inch thick. The panel clamps 41 comprise flexible plastic molded fixtures which wrap around each vertical piping portion 20 of the first 51 and second 52 uprights being affixed thereto front and rear surfaces of the panel 40 using screw-type fasteners 42 or the like. The panel clamps 41 comprise open-end clips which provide a clamping friction-fit thereto the first 51 and second 52 uprights when fastened thereto the panel 40. The panel 40 also provides an attachment means thereto a pair of pockets 43 affixed therealong opposite side surfaces. The pockets 43 provide a temporary holding means thereto full or empty balloons 60 and/or other water-based toys. The pockets 46 comprise three-sided open-top enclosures made using preferably, but not exclusively, open nylon or polypropylene mesh webbing with an elastic upper edging 44 affixed thereto using adhesives, sewing techniques, or the like. The pockets 43 further comprises an attachment means thereto the panel 40 via a border 45. The border 45 comprises a flat plastic or metal plate approximately one (1) inch wide covering side and lower edges of the pocket 43, thereby clamping said pocket 43 securely thereagainst the panel 40. The border 45 is affixed thereto the panel 40 using common fasteners 46 such as screws, rivets, or the like. The pocket 43 is illustrated here being held in place using a flat border 45; however, other methods may also be provided with equal benefit such as button snaps, hook- and loop fasteners, or the like, and as such should not be interpreted as a limiting factor of the invention 10. The panel 40 is envisioned to be introduced in a variety of decorative colors and patterns and may also display various printed indicia being suitable to particular events such as birthdays, community events, and the like.

The second upright portion 52 further provides a water inlet means thereto the apparatus 10 via a tee fitting 21 and a garden hose adapter 24 affixed thereto and located at a lower portion of the vertical piping portion 20 of the second upright 52. The garden hose connector 24 provides a fluid connection means thereto a standard three-quarter (¾) inch garden hose 80, thereby providing a water flow thereto the apparatus 10. The garden hose connector 24 is envisioned to comprise a standard plumbing fitting being fastened thereto the tee fitting 21 via threads or adhesives using common plumbing joining methods. The garden hose connector 24 is envisioned being made using PVC, brass, copper, or a combination thereof.

The apparatus 10 is illustrated here depicting a preferred embodiment comprising at least four (4) water flow valves 26; however, it is understood that different models of the apparatus 10 may provide a lesser or greater number of valves 26 located along a shorter or longer horizontal manifold 50 based upon an anticipated number of participants without deviating from the concept.

Referring now to FIG. 2, a side section view of the apparatus 10 taken along section A-A, according to a preferred embodiment of the present invention, is disclosed. The apparatus 10 comprises a horizontal manifold 50, a first upright 51, and four (4) water flow valves 26. The horizontal manifold 50 provides an attachment means thereto four (4) outwardly angled water flow valve tee fittings 29 (two shown here). Each water flow valve tee fitting 29 provides an attachment means thereto a water flow valve 26 via a threaded or cemented connection using conventional plumbing joining techniques being common in the industry. The valves 26 comprise preferably of quarter-turn ball valves; however, said valves 26 may be provided in other valve styles such as a push-pull, gate, lever-activated, or the like. The valves 26 are preferably made using PVC materials with brass or stainless steel internal components; however, other materials may be provided such as acrylonitrile butadiene styrene (ABS), brass, copper, stainless steel, or a combination thereof. The valves 26 comprise expected features such as an "L" or "T"-shaped handle 27 and an outlet port which provides a threaded or cemented attachment means thereto a nozzle 28 which provides a gripping and holding means thereto a balloon 60 during filling. The nozzle 28 comprises an enlarged annular ring located at an end portion thereof allowing a participant to stretch a balloon 60 around the nozzle 28, thereby helping to hold said balloon 60 thereto said nozzle 28 during filling.

It is envisioned that other styles and configurations of the present invention can be easily incorporated into the teachings of the present invention, and only one particular configuration shall be shown and described for purposes of clarity and disclosure and not by way of limitation of scope.

The preferred embodiment of the present invention can be utilized by the common user in a simple and effortless manner with little or no training. After initial purchase or acquisition of the apparatus 10, it would be installed as indicated in FIGS. 1 and 2.

The method of installing and utilizing the apparatus 10 may be achieved by performing the following steps: placing the apparatus 10 securely upon a level ground surface 70 using the foot portions 53; installing the panel 40 thereto the first 51 and second 52 uprights using the clamps 41 and provided first set of fasteners 42, if not previously assembled; attaching the pockets 43 and border portion 45 thereto the panel 40, if not previously assembled; connecting a common garden hose 80 thereto the garden hose connector 24; remotely supplying a flow of water via said garden hose 80 thereto the apparatus 10; placing new empty balloons 60 within the pockets 43; stretching a balloon 60 over the nozzle 28; opening the valve 26 by manually turning the handle 27 approximately ninety (90) degrees; filling the balloon 60 with water thereto a desired size; closing the valve 26 using the handle 27; removing the balloon 60 from the nozzle 28; tying the balloon 60 shut in an expected manner; filling water-based toys in like manner; repeating the process of filling balloons 60 and water-based toys as desired; and, enjoying a convenience of coincidentally dispensing and filling water-based toys and balloons 60 by a plurality of participants while also minimizing water consumption.

The foregoing descriptions of specific embodiments of the present invention have been presented for purposes of illustration and description. They are not intended to be exhaustive or to limit the invention and method of use to the precise forms disclosed. Obviously many modifications and variations are possible in light of the above teaching. The embodiment was chosen and described in order to best explain the principles of the invention and its practical application, and to thereby enable others skilled in the art to best utilize the invention and various embodiments with various modifications as are suited to the particular use contemplated. It is understood that various omissions or substitutions of equivalents are contemplated as circumstance may suggest or render expedient, but is intended to cover the application or implementation without departing from the spirit or scope of the claims of the present invention.

What is claimed is:

1. A refilling apparatus, comprising: a horizontal manifold comprising:

a first end connected to a first top end of a first upright by a first elbow fitting said first upright having a first bottom end connected to a first foot portion by a first tee fitting and a second end connected to a second top end of a second upright by a second elbow fitting at an opposite end said second upright having a second bottom end connected to a second foot portion by a second tee fitting; at least one (1) water flow valve mounted thereto said horizontal manifold by at least one (1) water flow valve tee fitting; and, a garden hose adapter affixed thereto a lower portion of said first upright or said second upright by a third tee fitting providing a fluid connection means thereto a standard garden hose, thereby providing a water flow to said apparatus; wherein said refilling apparatus enables a plurality of users to simultaneously fill a plurality of water-based toys; a panel having a front surface and a rear surface connected to said first upright and said second upright by at least one (1) panel clamp; and, at least one (1) pocket attached to said front surface and said rear surface of said panel by a border portion; wherein said at least one (1) panel clamp wraps around either said first upright or said second upright and is affixed thereto said front surface and said rear surface of said panel; said panel comprises a sturdy vertical flat surface made using plastics or metal materials being approximately twelve (12) inches tall and one-eight (⅛) to one-quarter (¼) inch thick; said at least one (1) panel clamps is an open-ended clip which provide a clamping friction-fit thereto said first upright or said second upright and affix to said front surface and said rear surface of said panel by a first plurality of fasteners; said pockets comprise three (3) sided open-top enclosures made using open nylon or polypropylene mesh webbing with an elastic upper edging affixed using adhesives, sewing techniques, or similar means; and, said border comprises a flat plastic or metal plate approximately one (1) inch wide covering a side edge and a lower edge of said pocket, thereby clamping said pocket securely there against said panel by a second plurality of fasteners.

2. The apparatus of claim 1, wherein said water flow valves each comprise an "L"-shaped handle or a "T"-shaped handle and an outlet port which provides an attachment means thereto a nozzle, thereby providing a gripping and a holding means thereto one (1) of said plurality of water-based toys.

3. The apparatus of claim 1, wherein said at least (1) water flow valve is angularly mounted thereto said horizontal manifold by at least (1) water flow valve tee fitting.

4. The apparatus of claim 1, wherein said apparatus further comprises four (4) panel clamps and two (2) pockets.

5. The apparatus of claim 1, wherein said apparatus comprises four (4) water flow valves and four (4) water flow valve tee fittings.

6. The apparatus of claim 5, wherein said four (4) water flow valves are each angularly mounted downwardly from a horizontal plane at an approximately forty-five degree (45°) angle therefrom said horizontal manifold by said four (4) water flow valve tee fittings;

wherein said water flow valve tee fittings are arranged such that two (2) water flow valve tee fittings face in a forward direction and two (2) water flow valve tee fittings face in a rearward direction in a staggered or alternating pattern.

7. The apparatus of claim 1, wherein said first foot portion and said second foot portion form two (2) parallel stabilizing members being approximately thirty (30) inches in length and arranged approximately thirty-four (34) inches therebetween providing a stable foundation thereby preventing sliding or tipping of said apparatus during use.

8. The apparatus of claim 1, wherein said horizontal manifold, said first upright, and said second upright form an inverted "U"-shaped structure approximately twenty-four (24) inches wide and approximately thirty-four (34) inches high.

9. The apparatus of claim 1, wherein said first upright and said first foot portion form a "T"-shaped leg structure.

10. The apparatus of claim 1, wherein said second upright and said second foot portion form a "T"-shaped leg structure.

11. The apparatus of claim 1, wherein said garden hose adapter comprises a standard plumbing fitting being fastened thereto said third tee fitting.

12. The apparatus of claim 1, wherein said garden hose adapter is made using PVC, brass, copper, or a combination thereof.

13. The apparatus of claim 1, wherein said horizontal manifold, said first upright, said second upright, said first foot portion, and said second foot portion each are made of common PVC piping.

14. The apparatus of claim 1, wherein said horizontal manifold, said first upright, said second upright, said first foot portion, and said second foot portion each are made of brass, copper, or similar materials.

15. A method for using a water-based toy refilling apparatus that allows a plurality of water-based toys to be easily filled simultaneously by a plurality of users, said method comprising the steps of: providing said apparatus, comprising: a horizontal manifold comprising: a first end connected to a first top end of a first upright by a first elbow fitting said first upright having a first bottom end connecting to a first foot portion by a first tee fitting and a second end connected to a second top end of a second upright by a second elbow fitting at an opposite end said second upright having a second bottom end connecting to a second foot portion by a second tee fitting; at least one (1) water flow valve mounted thereto said horizontal manifold by at least one (1) water flow valve tee fitting; a garden hose adapter affixed thereto a lower portion of said first upright or said second upright by a third tee fitting providing a fluid connection means thereto a standard garden hose, thereby providing a water flow to said apparatus; a panel having a front surface and a rear surface connected to said first upright and said second upright by at least one (1) panel clamp, wherein said at least one (1) panel clamp wraps around either said first upright or said second upright and is affixed thereto said front surface and said rear surface of said panel; and, at least one (I) pocket attached to said front surface and said rear surface of said panel by a border portion; placing said apparatus securely upon a level ground surface using said first foot portion and said second foot portion; installing said panel thereto said first upright and said second upright using said at least one (1) panel clamp and said first plurality of fasteners, if not; attaching said at least one (1) pocket and said border portion thereto said panel, if not previously assembled; connecting said standard garden hose thereto said garden hose adapter; remotely supplying said water flow via said garden hose thereto said apparatus; placing one (I) of a plurality of water-based toys within said pockets; stretching one (I) of said plurality of water-based toys over a nozzle; opening said water flow valve manually turning a handle; filling one (I) of said plurality of water-based toys with water thereto a desired water volume; closing said water flow valve using said handle; removing one (1) of said water-based toys from said nozzle; filling a remainder of said plurality of water-based toys as in the previous steps.

16. A water-based toy refilling apparatus, comprising: a horizontal manifold comprising: a first end connected to a first top end of a first upright by a first elbow fitting said first upright having a first bottom end connected to a first foot portion by a first tee fitting and, a second end connected to a second top end of a second upright by a second elbow fitting at an opposite end said second upright having a second bottom end connected to a second foot portion by a second tee fitting; at least one (1) water flow valve mounted thereto said horizontal manifold by at least one (1) water flow valve tee fitting; a garden hose adapter affixed thereto a lower portion of said first upright or said second upright by a third tee fitting providing a fluid connection means thereto a standard garden hose, thereby providing a water flow to said apparatus; a panel having a front surface and a rear surface connected to said first upright and said second upright by at least one (1) panel clamp; at least one (1) pocket attached to said front surface and said rear surface of said panel by a border portion; wherein said refilling apparatus enables a plurality of users to simultaneously fill a plurality of water-based toys; and, wherein said at least one (1) panel clamp wraps around either said first upright or said second upright and is affixed thereto said front surface and said rear surface of said panel; wherein said apparatus further comprises: said panel comprises a sturdy vertical flat surface made using plastics or metal materials being approximately twelve (12) inches tall and one-eight (⅛) to one-quarter (¼) inch thick; said at least one (1) panel clamp is an open-ended clip which provide a clamping friction-fit thereto said first upright or said second upright and affix to said front surface and said rear surface of said panel by a first plurality of fasteners; said pockets comprise three (3) sided open-top enclosures made using open nylon or polypropylene mesh webbing with an elastic upper edging affixed using adhesives, sewing techniques, or similar means; said border comprises a flat plastic or metal plate approximately one (1) inch wide covering a side edge and a lower edge of said pocket thereby clamping said pocket securely there against said panel by a second plurality of fasteners; said water flow valves each comprise an "L"-shaped handle or a "T"-shaped handle and an outlet port which provides an attachment means thereto a nozzle, thereby providing a gripping and a holding means thereto one (1) of said plurality of water-based toys during filling; said apparatus comprises four (4) water flow valves and four (4) water flow valve tee fittings; and, said four (4) water flow valves are each angularly mounted downwardly from a horizontal plane at an approximately forty-five degree (45°) angle therefrom said horizontal manifold by said four (4) water flow valve tee fittings; wherein said water flow valve tee fittings are arranged such that two (2) water flow valve tee fittings face in a forward direction and two (2) water flow valve tee fittings face in a rearward direction in a staggered or alternating pattern.

* * * * *